US007367683B2

(12) United States Patent
Marcelle et al.

(10) Patent No.: US 7,367,683 B2
(45) Date of Patent: May 6, 2008

(54) ILLUMINATING MECHANISM FOR A LOCK

(75) Inventors: Jesse Marcelle, Franklin, WI (US); Glenn Meekma, Menomonee Falls, WI (US); Vince Leslie, Greendale, WI (US); Christopher Rohde, West Allis, WI (US)

(73) Assignee: Master Lock Company LLC, Oak Creek, WI (US)

( * ) Notice: Subject to any disclaimer, the term of this patent is extended or adjusted under 35 U.S.C. 154(b) by 8 days.

(21) Appl. No.: 10/906,884

(22) Filed: Mar. 10, 2005

(65) Prior Publication Data

US 2005/0201076 A1 Sep. 15, 2005

Related U.S. Application Data

(60) Provisional application No. 60/521,209, filed on Mar. 11, 2004.

(51) Int. Cl.
*E05B 17/00* (2006.01)

(52) U.S. Cl. ..... 362/100; 362/23

(58) Field of Classification Search ..... 362/100, 362/23, 116, 253; 70/445–446, 332
See application file for complete search history.

(56) References Cited

U.S. PATENT DOCUMENTS

| | | | |
|---|---|---|---|
| 317,772 | A | 5/1885 | Hatch |
| 922,065 | A | 5/1909 | Townsend |
| 0,961,884 | A | 6/1910 | Mosler |
| 1,000,889 | A | 8/1911 | Bennett |
| 1,302,896 | A | 5/1919 | Burgess |
| 1,525,124 | A | 2/1925 | Fox |
| 2,153,831 | A | 4/1939 | Gudge |
| 2,566,490 | A | 9/1951 | Heinz |
| 4,078,248 | A | 3/1978 | Hill |
| 4,453,390 | A | 6/1984 | Moritz et al. |
| 4,455,552 | A | 6/1984 | Greiner et al. |
| 4,631,940 | A | 12/1986 | Krivec et al. |
| 4,819,465 | A | 4/1989 | Stanich |
| D306,131 | S | 2/1990 | Coffman |

(Continued)

FOREIGN PATENT DOCUMENTS

DE 622 255 C 11/1935

(Continued)

OTHER PUBLICATIONS

Van Roon, Tony, 555 Tutorial, http://www.uoguelph.ca/~antoon/gadgets/555/555.html, pp. 1-3, copyright © 1995 Tony van Roon (VA3AVR).*

(Continued)

*Primary Examiner*—Jong-Suk (James) Lee
*Assistant Examiner*—Julie A. Shallenberger
(74) *Attorney, Agent, or Firm*—Calfee, Halter & Griswold LLP

(57) ABSTRACT

A lock including an illuminating device which is actuated by the rotation of a lock dial produces an illumination event. The illumination event provides sufficient light on the lock such as to allow easier operation of the lock in areas of inadequate light. The lock may include a piezo device which creates electrical current to light one or more light emitting diodes for a predetermined duration of time.

13 Claims, 6 Drawing Sheets

U.S. PATENT DOCUMENTS

| | | | | |
|---|---|---|---|---|
| 5,015,918 | A * | 5/1991 | Copeland | 315/76 |
| 5,057,975 | A | 10/1991 | Evigan | |
| 5,179,325 | A | 1/1993 | Aragon, Jr. | |
| 5,404,735 | A | 4/1995 | Hsieh | |
| 5,493,279 | A | 2/1996 | Dawson et al. | |
| 5,522,243 | A | 6/1996 | Kusmiss | |
| 5,546,776 | A | 8/1996 | Sun et al. | |
| 5,587,702 | A | 12/1996 | Chadfield | |
| 5,598,727 | A | 2/1997 | White | |
| 5,604,489 | A | 2/1997 | Hyatt, Jr. | |
| 5,664,446 | A | 9/1997 | Kusmiss | |
| 5,684,457 | A | 11/1997 | Miller | |
| 5,727,405 | A | 3/1998 | Cromwell | |
| D397,026 | S | 8/1998 | Drake | |
| 5,832,752 | A | 11/1998 | Zeller | |
| 6,019,480 | A | 2/2000 | Polkow | |
| 6,047,575 | A | 4/2000 | Larson et al. | |
| D427,884 | S | 7/2000 | Castellanos et al. | |
| 6,086,223 | A | 7/2000 | Fogle et al. | |
| 6,176,589 | B1 | 1/2001 | Ishiguro | |
| 6,345,898 | B1 | 2/2002 | Roach | |
| 6,370,929 | B1 | 4/2002 | Watanabe et al. | |
| 6,461,005 | B2 | 10/2002 | Roach | |
| 6,478,437 | B2 | 11/2002 | Roach | |
| 2003/0012020 | A1 | 1/2003 | King | |
| 2004/0125585 | A1 * | 7/2004 | Sung | 362/26 |

FOREIGN PATENT DOCUMENTS

| | | |
|---|---|---|
| DE | 34 11 777 A1 | 5/1985 |
| DE | 88 06 772 U1 | 7/1988 |
| DE | 92 09 902 U1 | 10/1992 |
| DE | 199 39 627 | 5/2000 |

OTHER PUBLICATIONS

Partial International Search Report from PCT/US2005/008132.
European Search Report from Application No. 05725349.4, dated May 11, 2007, 3 pages.
website printout - The Punishment Zone, Lets Us Break your Flashlight, Light-Uplocks; hhtp://ledmuseum.candlepower.us/seventh/padlock.htm; dated Aug. 13, 2007; 8 pages.
website printout - Marine and Nautical Gifts and Accessories; http://solentmarine.co.uk/acatalog/gifts.accessories.html; dated Aug. 10, 2007; 1 page.

* cited by examiner

ILLUMINATING MECHANISM FOR A LOCK

CROSS-REFERENCE TO RELATED PATENT APPLICATIONS

This application claims the benefit of U.S. Provisional Patent Application Ser. No. 60/521,209 filed on Mar. 11, 2004, the entire disclosure of which is hereby incorporated by reference.

FIELD OF THE INVENTION

The present invention is directed to an improved combination lock, and more specifically to a combination lock which includes a means for illuminating a portion of the combination dial.

BACKGROUND

Security devices, such as locks, are used in a variety of applications to secure a variety of objects. In some instances the security device may be used in areas of low light, which may impede or complicate operation of the security device. For example, operation of a combination dial to locate the correct number of the unlocking combination or locating the keyhole for insertion of the appropriate key may be difficult in areas of low light. As such, it is desirable to provide a security device that produces sufficient light to allow easy operation of the security device.

SUMMARY OF THE INVENTION

A lock including an illuminating device which is actuated by the rotation of a lock dial to produce an illumination event is disclosed. The illumination event provides sufficient light on the lock such as to allow easier operation of the lock in areas of inadequate light. In some embodiments, the lock may include a piezo device which creates electrical current to light one or more light emitting diodes for a predetermined duration of time.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below serve to illustrate the principles of this invention.

DESCRIPTION OF THE INVENTION

Figure 1:
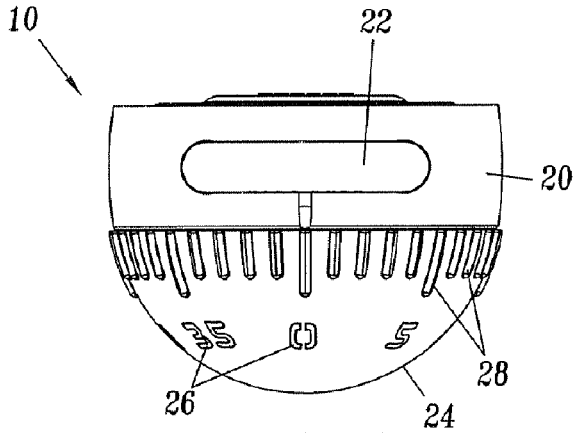
FIG. 1 is a top view of an illustrative embodiment of a lock incorporating an illuminating mechanism.
Figure 4:
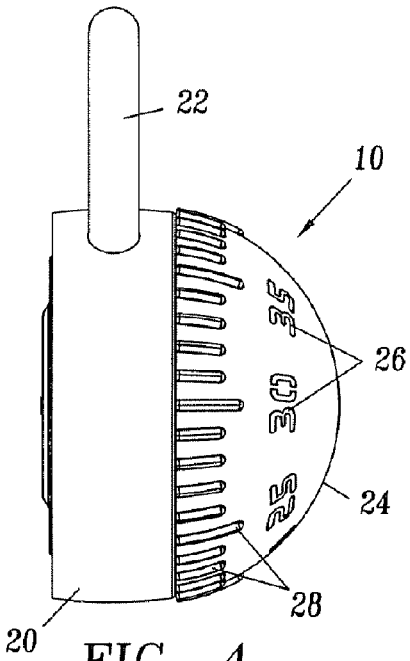
FIG. 4 is a side view of the lock shown in FIG. 1.
Figure 2:
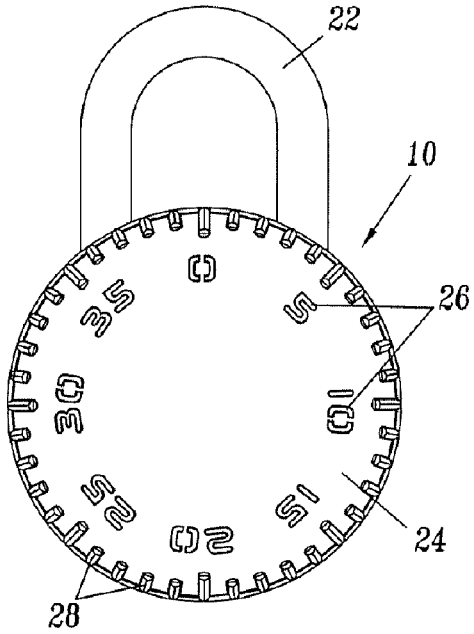
FIG. 2 is a front view of the lock shown in FIG. 1.
Figure 3:
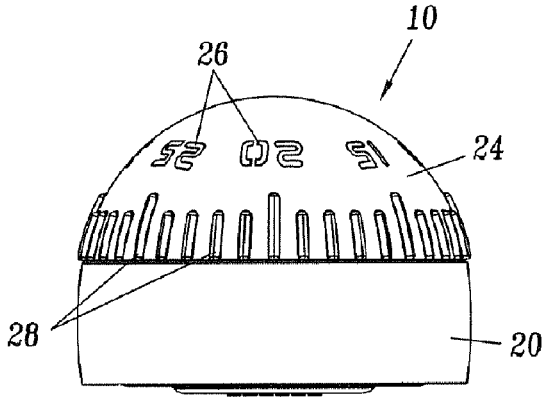
FIG. 3 is a bottom view of the lock shown in FIG. 1.
Figure 5:
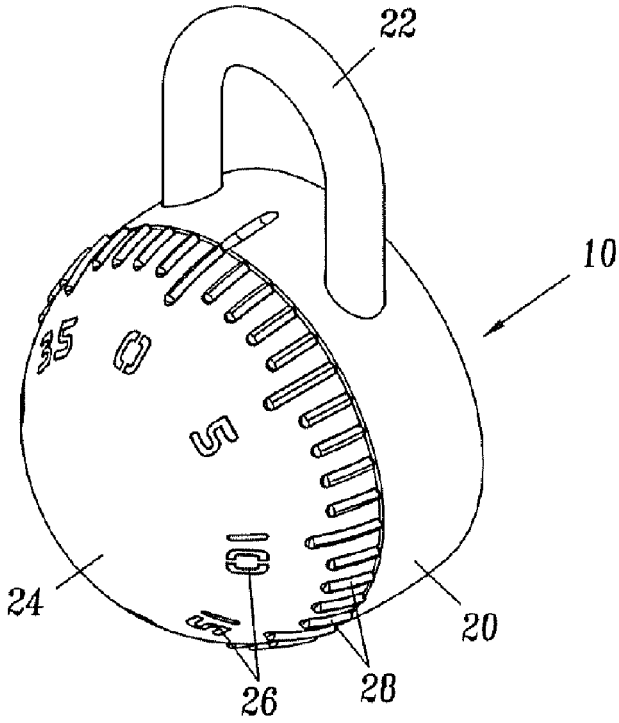
FIG. 5 is a front perspective view of the lock shown in FIG. 1.
Figure 6:
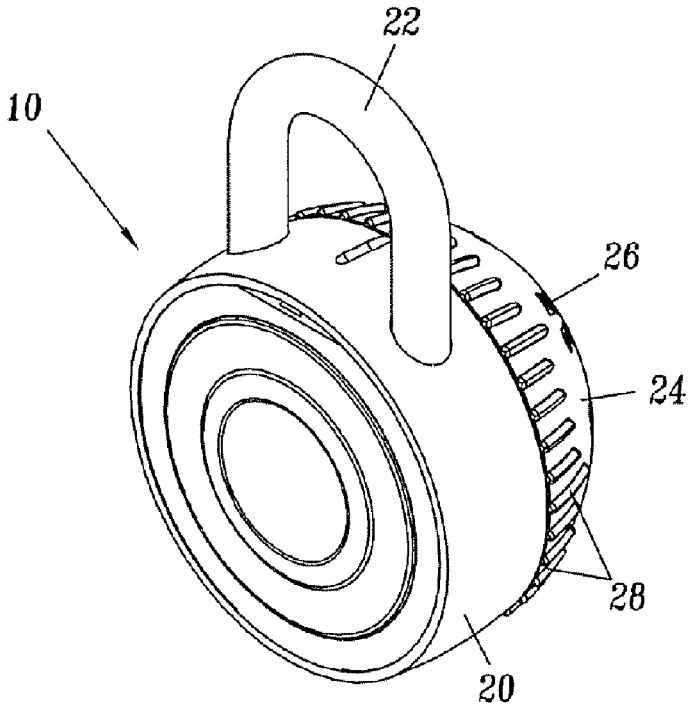
FIG. 6 is a back perspective view of the lock shown in FIG. 1.

FIGS. 1-6 illustrate one embodiment of a lock incorporating a illuminating mechanism for improved operability in areas of low light. The illuminating mechanism is housed within the lock body and when activated, provides light that allows the user to view the lock with sufficient light to allow for operation of the lock. In the embodiment shown in FIGS. 1-6, light emits from areas, such as, for example, the numbers or number markers. Additionally, light may also emit through other features, such as a logo, the edges of the dial, or patterns formed in the dial, or any combination thereof. The light source can be used to improve operability of the lock in areas of low light and/or may provide an enhanced aesthetic appearance. It should be appreciated that FIGS. 1-4 illustrate only one exemplary embodiment of the present invention and that other embodiments incorporating the features disclosed herein are also contemplated. While the illustrative example is directed to a specific combination padlock, the features of the present invention could be applied to many other products, such as other combination locks, door locks, locker locks, padlocks or keyed locks.

The lock 10 shown in FIGS. 1-6 includes the standard features of a combination lock, namely a lock body 20, a shackle 22, and a combination dial 24. The combination dial 24 includes numbers 26 and number markers 28, although other combination lock dial features may also be used. The combination lock 10 shown in FIGS. 1-6 may use any conventional locking mechanism.

Figure 7:
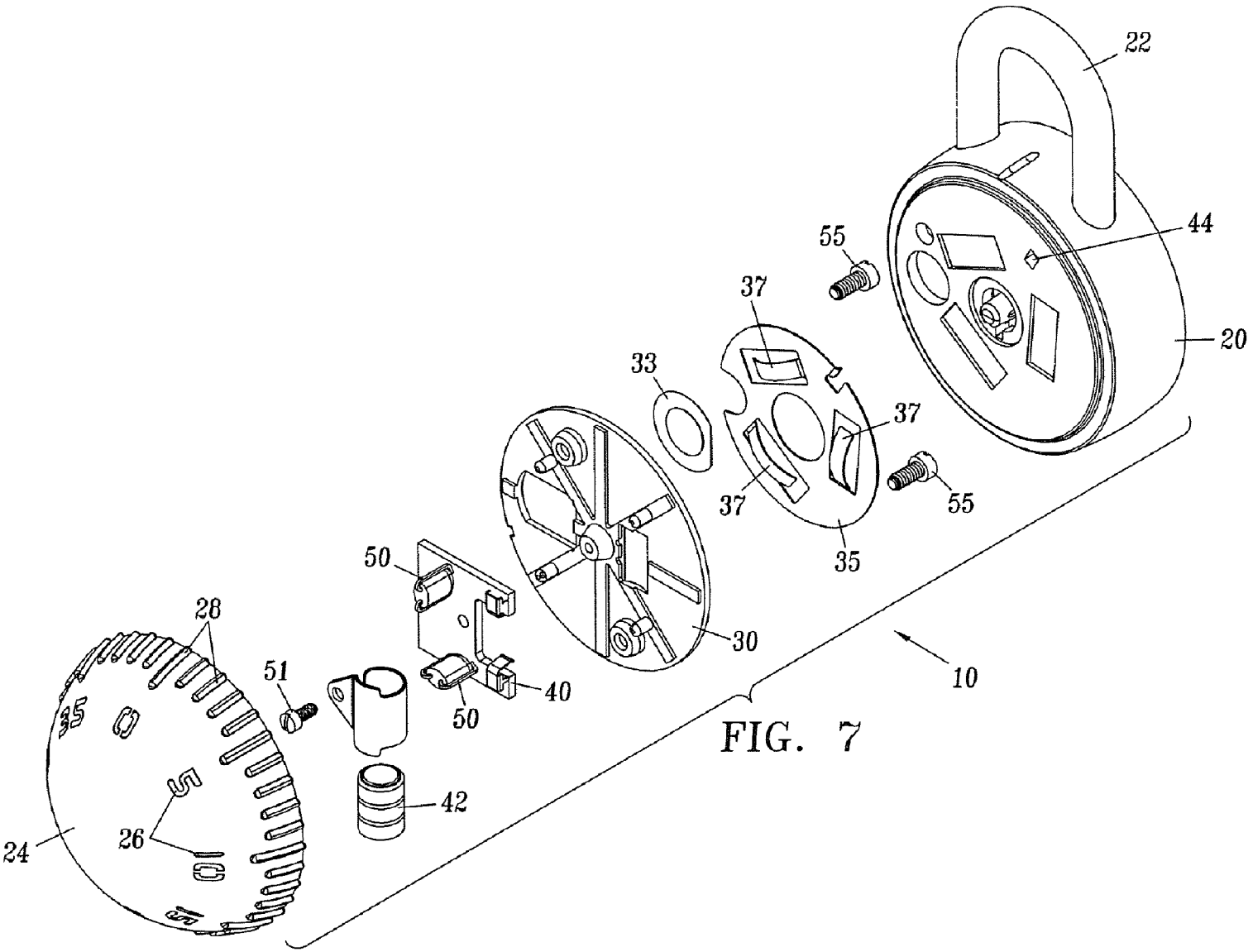
FIG. 7 is a front exploded view of the lock shown in FIG. 1.
Figure 8:
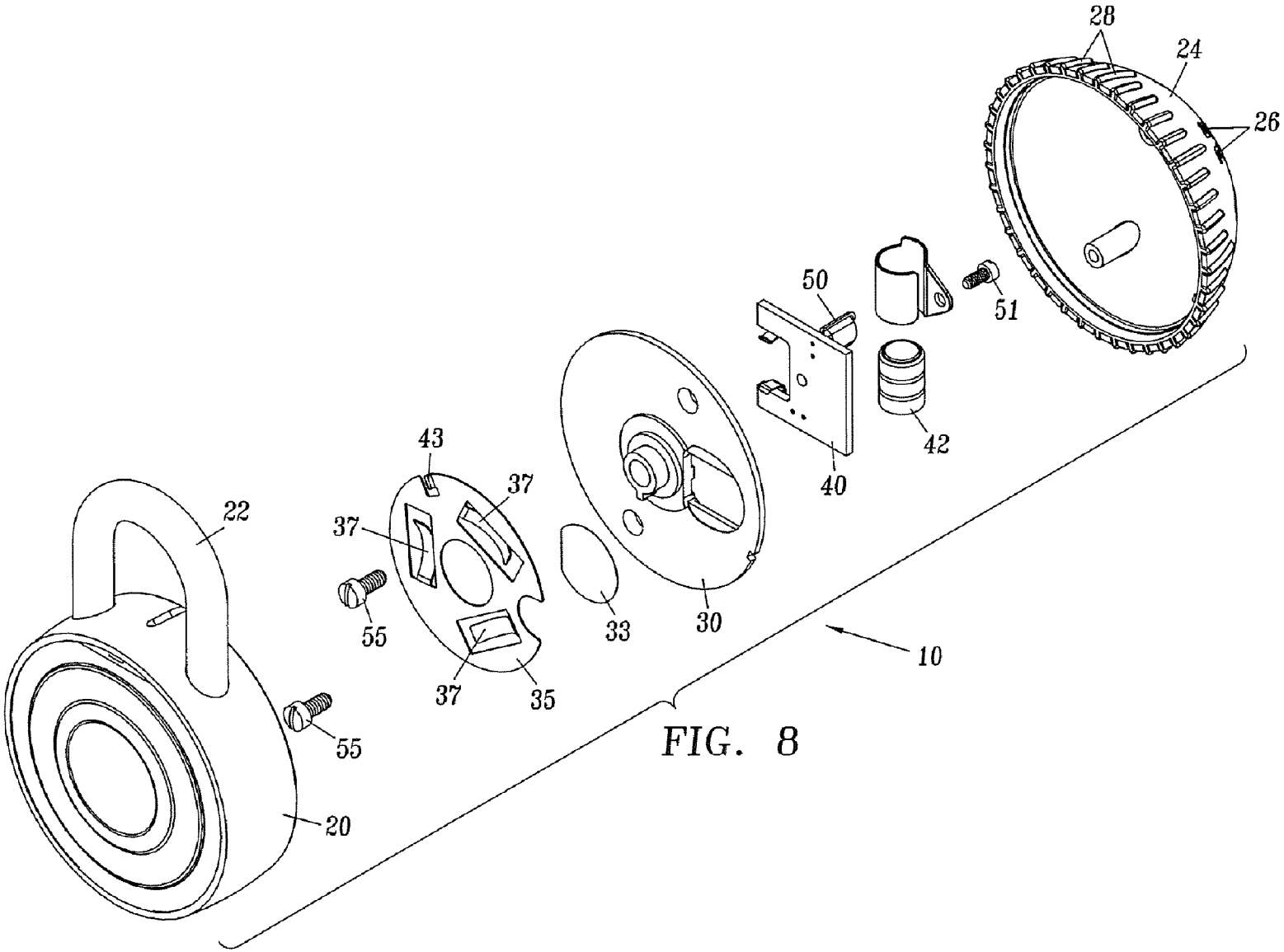
FIG. 8 is a rear exploded view of the lock shown in FIG. 1.

FIGS. 7 and 8, illustrates an exploded view of the lock 10 shown in FIGS. 1-6. The lock 10 shown in FIGS. 7 and 8 includes dial base 30 located between the lock body 20 and the dial 24. Also illustrated is one embodiment of the illuminating mechanism. Included are a piezo device 33, a piezo wiper 35 having three piezo wiper springs 37, a print circuit board (PCB) 40, and a power source 42. The power source 42 is shown as several small coin cell lithium batteries, however it should be appreciated by one skilled in the art that any power source could be used. For example the power source may be batteries, fuel cells, solar power, or the like and will define the performance and several other properties or product characteristics of the lock and illuminating mechanism.

As shown in FIGS. 7 and 8, the illuminating mechanism is disposed within the lock dial 24 and thereby provides an area for the illuminating mechanism that is away from the locking mechanism. This allows the illuminating mechanism to be accessed without granting access to the locking mechanism, which would potentially compromise the integrity of the lock. Furthermore, while the dial 24 is shown as a hollow semi-spherical shape, it should be appreciated that other embodiments can incorporate other types or configurations of the lock dial. The hollow, semi-spherical dial allows for ease of incorporation of the illuminating mechanism.

The piezo wiper 35 is shown as a stamped metal disk with three wiper springs 37 and a tab 43 to engage a fixed point 44 in the lock body 20. Although three wiper springs 37 are shown, it should be appreciated that only a single wiper spring 37 is needed. It should be appreciated that any number of piezo wiper springs 37 can be used, however three piezo wiper springs are preferred in order to trigger the light on with one third of a dial rotation and to provide a balanced three point surface to support the dial base 30 evenly. Furthermore, the piezo wiper springs 37 can be tangent to the centerline of the lock body or can be perpendicular in orientation. The piezo wiper 35 is fixed in location with respect to the lock body 20. The piezo device 33 is mounted to the underside of the dial base 30, by any known means including, but not limited to, snap fit, staking, adhesive or the like. The wiper springs 37 on the piezo wiper 35 brush against the piezo device 33, which produces a voltage signal, as described below. The dial base 30, zinc die cast as shown, is crimped to the lock body 20 and traps the piezo wiper 35 between dial base 30 and lock body 20. The dial base 30 rotates freely with respect to the lock body 20 in both directions.

A PCB (Printed Circuit Board) 40 with one or more LED's 50 is attached with the PCB to the dial base 30 via any conventional means, such as a screw 51. The use of the Light Emitting Diodes (LED's) provides illumination of a portion of the lock, such as the lock dial, thereby increasing visibility and ease of use during operation of the lock. The number and type of LED's depends on the amount of light that is desired.

In some embodiments a reflector (not shown) is used to cover the PCB 40 and dial base 30, while allowing the LED(s) to pass through and reside between the dial 24 and reflector. The reflector is preferably high gloss white in color or a metallic or mirror like finish to reflect the light produced by the LED(s) toward the dial. In other embodiments, the PCB 40 is painted or coated with a reflective material. The use of a reflector or reflective coating is optional and is used to enhance or focus the light emitted from the LED(s).

The dial 24 is generally composed of two contrasting materials. The outer surface, with the exception of the illuminated areas, is made from a material that is solid such that light cannot transmit through it. Plastic or zinc die cast materials are the preferred. The inner material that also protrudes to the outside surface at areas to be illuminated, such as, for example, the numbers 26, logo (not shown), number marks 28, and other desired illuminated areas, is made of semitransparent plastic, such as, for example, polycarbonate or acrylic, which are typically used for light pipe applications. The inner surface material can be either be semi-transparent colored material with a white LED or semi-transparent clear with a colored LED. As such the color of the illumination can be varied by changing LED color or inner material color. In some embodiments, the dial is composed of a single transparent material with markings, such as number on it. In other embodiments, the dial is composed of an opaque material and more than one semi-transparent materials or more than one color of semitransparent material. In such embodiments, the light emitted can be multi-colored for aesthetic purposes.

Two dial screws 55 are used to hold the dial 24, power source 42, and the PCB 40 assembly to the dial base 30. Screws, bolts or other removable fastening means are used in order to allow the user to gain access to the power source 42, such as, for example, to change the batteries. The dial screws could be replaced by a more permanent fixation means, such as glue, staking or other attachment means. Such other attachment means are more readily used if the power source can operate the product for an acceptable time period. Alternatively, a small removable battery door (not shown) could be integrated into the dial which would allow permanent dial attachment.

Pressing or rotating a lock dial 24 activates the LED's 50. The number of LED's 50 can be varied and will be determined by the amount of illumination desired. The LED's 50 will remain activated for predetermined time period after the dial 24 is released or ceases to rotate. For example, the LED's 50 may remain illuminated for a period of two to seven seconds. In other embodiments, the LED's 50 may remain illuminated a shorter or longer duration. Due to cost and space considerations, the circuitry should be kept simple and component costs should be relatively inexpensive. In addition, due to the limited battery power, the circuitry should also consume only small amounts of current.

Figure 9:
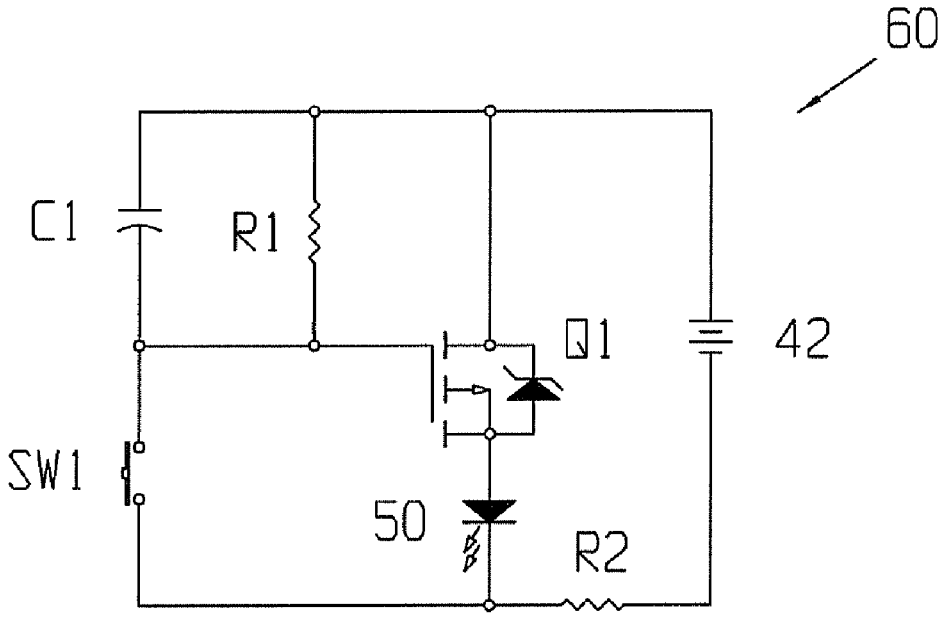
FIG. 9 is an example of a circuit for an illuminating mechanism.

As shown in FIG. 9, a circuit 60 with a Field Effect Transistor (FET) Q1 controls the LED(s) 50. While other mechanism can be used for controlling the LED(s) 50, a FET Q1 is preferred due to its high input impedance and allowance of a simple timing circuit that uses few components and low current draw (less then 1 uA) in the in-active state. To activate the LED's 50 when pushing the dial 24, a switch SW1 is used to charge capacitor C1. The charged capacitor C1 causes FET Q1 to turn "on" providing a low source/drain resistance which enables current to flow through LED 50. As long as SW1 is closed, or capacitor C1 is charged, Q1 remains in the "on" state. When SW1 is released capacitor C1 slowly discharges through resistor R1. The relative resistance of the resistor R1 determines the rate of capacitor discharge and thus the duration of the illumination event. When the capacitor C1 discharges to a voltage less than the gate threshold of the FET Q1, the source/drain resistance becomes a relatively high impedance, thereby stopping current and FET Q1 and LED 50 are turned off. The circuit is now ready for another event.

While the circuit described above provides for a sufficient illuminating circuit, when implementing the rotating dial event wake feature, the above circuit is difficult to use because the parked position that the dial is in could be a closed-switch position. The push dial wake-up feature can also contribute to low battery life because the dial can be inadvertently held down wasting battery life.

Figure 10:
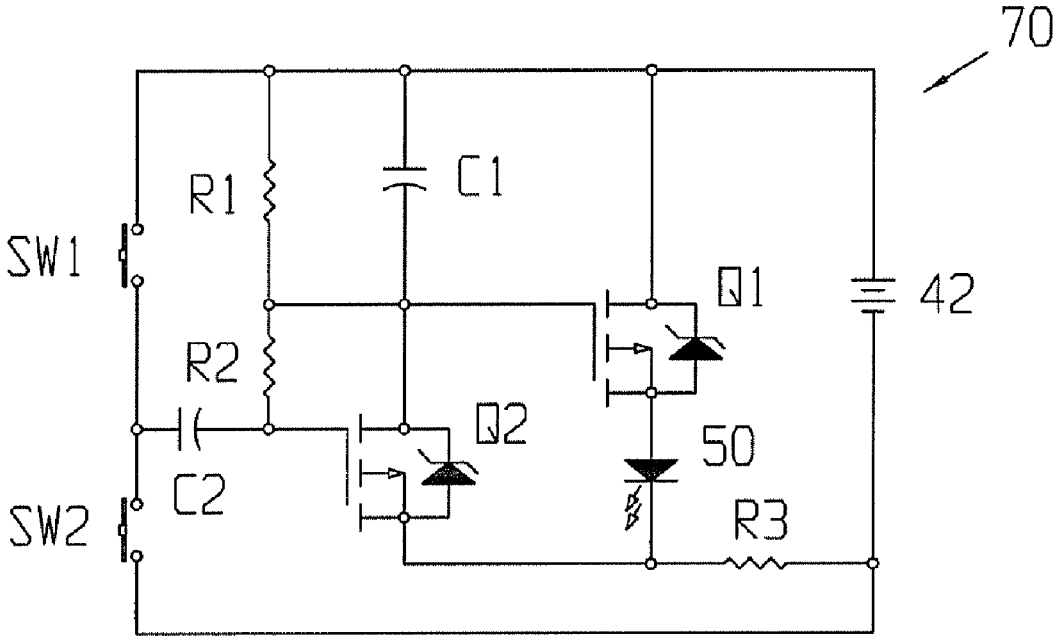
FIG. 10 is a second example of a circuit for an illuminating mechanism.

FIG. 10 details a circuit 70 that controls from a change in state versus a fixed low state. In order to achieve this a second FET Q2 is added to the circuit that is pulsed to the "on" state from a capacitor coupled signal. Because the signal is capacitor coupled through capacitor C2, FET Q2 is only momentarily on, even if SW1 or SW2 are held in the "on" state. This causes capacitor C1 that holds Q1 "on" to only momentarily be charged and never be held in the charged state. The two switches SW1 and SW2 can be integrated into the printed circuit copper and two spring contacts off the board. An alternative embodiment is the implementation of a momentary switch.

Figure 11:
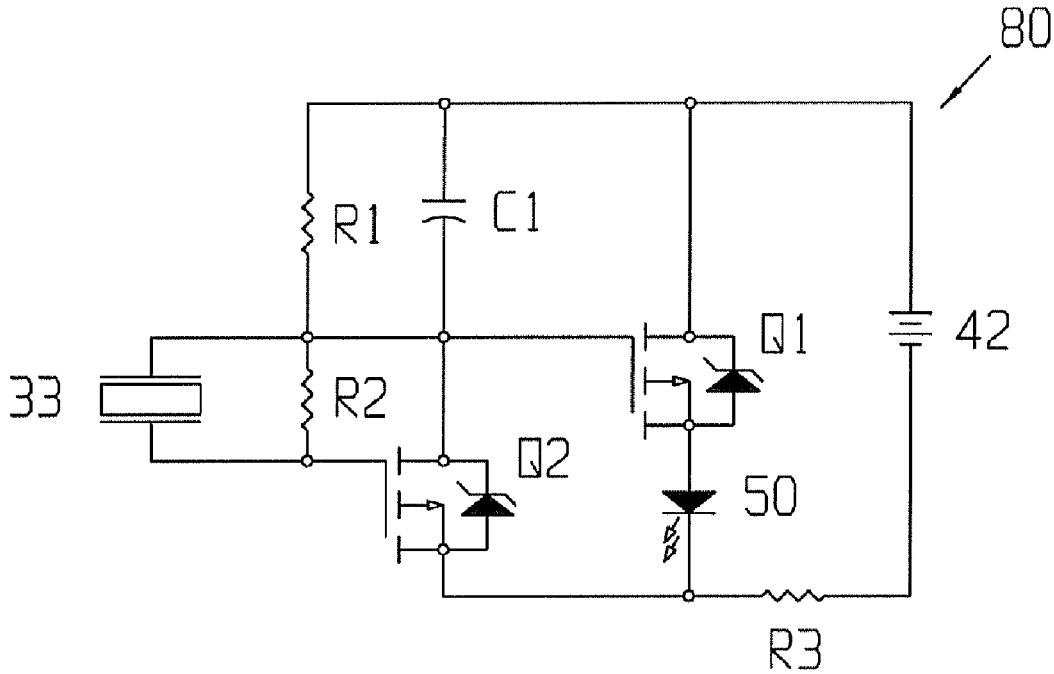
FIG. 11 is a third example of a circuit for an illuminating mechanism.

In FIG. 11, the capacitor C2 and the two switches SW1 and SW2, are replaced with a piezo device 33 to create circuit 80. To activate the LED(s) 50, rotating or pushing the dial 24 bends or flexes piezo device 33. This action causes the piezo device 33 to produce a voltage of sufficient magnitude to briefly turn "on" FET Q2. Using a piezo device 33 helps power consumption by adding energy to the circuit versus a passive switch or sensor that consumes energy from the battery. This is because a piezo device 33 generates surface charges in response to applied stresses. With FET Q2 turned "on", its source/drain resistance approaches zero thereby allowing capacitor C1 to charge. The charged capacitor causes FET Q1 to turn "on" where it now has a low source/drain resistance which enables current to flow through LED 50. With FET Q2 turned "off", the capacitor slowly discharges through resistor R1 holding FET Q1 "on". The discharge time sets the LED "on" time. When the capacitor discharges to a voltage less than the gate threshold of FET Q1, the FET source/drain resistance becomes a relatively high impedance, stopping current and FET Q1 and LED 50 are turned off. The circuit is now ready for another piezo event.

The invention has been described with reference to the preferred embodiment. Clearly, modifications and alterations will occur to others upon a reading and understanding of this specification. It is intended to include all such modifications and alterations insofar as they come within the scope of the appended claims or the equivalents thereof.

What is claimed is:

1. A lock comprising:

a lock body;

a lock dial coupled to said lock body;

an illuminating mechanism disposed within said lock dial; and a piezo device affixed to the lock dial;

wherein the illuminating mechanism and piezo device are configured to illuminate the lock dial in response to movement of the lock dial relative to the lock body.

2. The lock of claim 1, wherein said lock dial is comprised of an opaque material and one or more semi-transparent materials.

3. The lock of claim 2, wherein said lock dial includes numbers and number markings comprised of said one or more semi-transparent materials.

4. The lock of claim 1, wherein said illuminating mechanism includes one or more light emitting diodes.

5. The lock of claim 1 further comprising a reflective surface located such that one or more light emitting diodes are located between the reflective surface and an inner surface of said lock dial.

6. The lock of claim 1, wherein said piezo device produces a charge when said lock dial is rotated relative to said lock body.

7. The lock of claim 1, wherein said illuminating mechanism includes one or more field effect transistors, one or more resistors and one or more capacitors.

8. The lock of claim 7, wherein said one or more resistors determine the rate of discharge of one or more of said capacitors, thereby determining the duration of an illumination event.

9. A lock comprising:

a lock body;

a lock dial coupled to said lock body;

a piezo device that generates electrical current that is used to light one or more light emitting diodes when said lock dial is rotated relative to said lock body; and at least one piezo wiper which includes one or more piezo wiper springs that brush against said piezo device to produce a voltage signal.

10. A lock comprising:

a lock body including a locking mechanism;

a lock dial coupled to said lock body;

a piezo device connected to a dial body;

a piezo wiper including one or more piezo washer springs; and one or more light emitting diodes; wherein rotation of the lock dial produces an illumination event, wherein said one or more light emitting diodes illuminate a portion of said lock.

11. The lock of claim 10, wherein said lock dial comprises an opaque material and one or more semi-transparent materials, and wherein said one or more light emitting diodes create said illumination event by emitting light through said one or more semi-transparent materials.

12. The lock of claim 10 further comprising a means for predetermining the duration of said illumination event.

13. The lock of claim 10 wherein said piezo device, said piezo wiper and said one or more light emitting diodes are disposed within said lock dial.

* * * * *